US011353233B2

(12) United States Patent
Funada et al.

(10) Patent No.: US 11,353,233 B2
(45) Date of Patent: Jun. 7, 2022

(54) AIR-CONDITIONING SYSTEM AND AIR-CONDITIONING SYSTEM CONTROLLER

(71) Applicant: Panasonic Intellectual Property Management Co., Ltd., Osaka (JP)

(72) Inventors: Naoyuki Funada, Aichi (JP); Ayumi Konishi, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 175 days.

(21) Appl. No.: 16/766,238

(22) PCT Filed: Nov. 15, 2018

(86) PCT No.: PCT/JP2018/042219
§ 371 (c)(1),
(2) Date: May 21, 2020

(87) PCT Pub. No.: WO2019/107163
PCT Pub. Date: Jun. 6, 2019

(65) Prior Publication Data

US 2020/0292198 A1 Sep. 17, 2020

(30) Foreign Application Priority Data

Nov. 28, 2017 (JP) ..... JP2017-227371
Sep. 28, 2018 (JP) ..... 2018-183092

(51) Int. Cl.
*F24F 11/74* (2018.01)
*F24F 1/0041* (2019.01)
(Continued)

(52) U.S. Cl.
CPC ..... *F24F 11/74* (2018.01); *F24F 1/0033* (2013.01); *F24F 1/0041* (2019.02); *F24F 2110/10* (2018.01)

(58) Field of Classification Search
CPC ..... F24F 1/0033; F24F 3/001; F24F 3/048; F24F 1/0035; F24F 1/0041; F24F 11/74; F24F 11/72; F24F 1/0007; F24F 1/00075
See application file for complete search history.

(56) References Cited

U.S. PATENT DOCUMENTS 3,567,115 A * 3/1971 Nelson ..... F24F 3/0522 236/1 B

FOREIGN PATENT DOCUMENTS

JP 2009-250442 A 10/2009
JP 2011-127845 A 6/2011
(Continued)

OTHER PUBLICATIONS

JP2011127845A Translation (Year: 2011).*
(Continued)

*Primary Examiner* — Schyler S Sanks
(74) *Attorney, Agent, or Firm* — Renner, Otto, Boisselle & Sklar, LLP

(57) ABSTRACT

This air-conditioning system includes an air conditioner: a room temperature sensor; an air-conditioning room temperature sensor; and a system controller. In the system controller, a room target temperature obtainer obtains a plurality of room target temperatures. Moreover, a ventilation airflow determiner determines the ventilation airflow of each of the delivery fans on the basis of the room target temperature, the temperature in the corresponding room, and the temperature in the air-conditioning room, and a fan airflow controller controls the ventilation airflow of each of the delivery fans according to the ventilation airflow determined by the ventilation airflow determiner.

12 Claims, 8 Drawing Sheets

(51) Int. Cl.
*F24F 1/0033* (2019.01)
*F24F 110/10* (2018.01)

(56) References Cited

FOREIGN PATENT DOCUMENTS

| | | | | |
|---|---|---|---|---|
| JP | 2011127845 | A | * | 6/2011 |
| JP | 2013-217620 | A | | 10/2013 |
| JP | 2017116113 | A | * | 6/2017 |

OTHER PUBLICATIONS

JP2017116113A Translation (Year: 2017).*
International Search Report for corresponding Application No. PCT/JP2018/042219, dated Feb. 5, 2019.

* cited by examiner

AIR-CONDITIONING SYSTEM AND AIR-CONDITIONING SYSTEM CONTROLLER

TECHNICAL FIELD

The present disclosure relates to an air-conditioning system and an air-conditioning system controller.

BACKGROUND ART

Conventionally, air-conditioning using a central air conditioner has been available for housing. In addition, with an increase in demand for energy-efficient homes and with more stringent regulations, it is expected that highly insulated and airtight homes will increase and thus, there are needs for air-conditioning systems suitable for such features.

For example, in a known method, in a highly insulated and airtight home including more than one room, air conditioners are separately provided, an air duct connecting an air-conditioning room and each room is provided, and a controller disposed in each room individually distributes and supplies the air inside the air-conditioning room, as described in Patent Literature (PTL) 1.

CITATION LIST

Patent Literature

PTL 1: Unexamined Japanese Patent Publication No. 2011-127845

SUMMARY OF THE INVENTION

Such a conventional air-conditioning system has the problem that in the case where rooms have different temperature settings when the cooler is in use, for example, it is difficult to freely set the temperature for each room. For example, in the case of air-conditioning using a central air conditioner, the central air conditioner is installed in a machine room, cools or heats air returned from rooms, and delivers the air to each of the rooms through ducts. The temperature inside a room is measured, for example, using a temperature adjuster (hereinafter referred to as a thermostat). The thermostat is installed in a room and when the set temperature and the temperature inside the room deviate from each other, the air conditioner is operated, and when the temperature inside the room reaches the set temperature, the air conditioner is stopped. In this case, the air-conditioning cannot be controlled for each room and the operating/stopping control is performed according to the temperature measured where the thermostat is installed, meaning that temperature adjustment in a room where the thermostat is not installed shall be made accordingly. In the case of individually distributing and supplying the air inside the air-conditioning room, it is not clear how to handle the individual temperature setting in each room; also in this case, there is the problem that temperature variations occur with the air distribution and supply only and fine temperature control is not possible.

Thus, the present disclosure is conceived to solve the aforementioned conventional problems and aims to provide an air-conditioning system that enables different temperature settings in two or more rooms.

An air-conditioning system according to one aspect of the present disclosure includes: an air conditioner which is installed in an air-conditioning room and conditions air in the air-conditioning room; a plurality of delivery fans which are installed, in one-to-one correspondence, for a plurality of rooms independent of the air-conditioning room, and deliver the air in the air-conditioning room into the plurality of rooms; a system controller which controls the air conditioner and the plurality of delivery fans; a room temperature sensor which obtains a temperature in each of the plurality of rooms and transmits the temperature in the room to the system controller; and an air-conditioning room temperature sensor which obtains a temperature in the air-conditioning room and transmits the temperature in the air-conditioning room to the system controller. The system controller includes: a room target temperature obtainer which obtains a plurality of room target temperatures set for the plurality of rooms in one-to-one correspondence; an air-conditioning room temperature controller which controls the temperature in the air-conditioning room by causing the air-conditioning room to have a temperature lower than or equal to a lowest one of the plurality of room target temperatures when the air conditioner operates in a cooling mode, and causing the air-conditioning room to have a temperature higher than or equal to a highest one of the plurality of room target temperatures when the air conditioner operates in a heating mode; a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by the room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner.

An air-conditioning system controller according to another aspect of the present disclosure controls an air conditioner which is installed in an air-conditioning room and conditions air in the air-conditioning room and a plurality of delivery fans which are installed, in one-to-one correspondence, for a plurality of rooms independent of the air-conditioning room, and deliver the air in the air-conditioning room into the plurality of rooms. The air-conditioning system controller includes: a room target temperature obtainer which obtains a plurality of room target temperatures set for the plurality of rooms in one-to-one correspondence; an air-conditioning room temperature controller which controls a temperature in the air-conditioning room by causing the air-conditioning room to have a temperature lower than or equal to a lowest one of the room plurality of target temperatures when the air conditioner operates in a cooling mode, and causing the air-conditioning room to have a temperature higher than or equal to a highest one of the room plurality of target temperatures when the air conditioner operates in a heating mode; a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by a room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner.

According to the present disclosure, it is possible to provide an air-conditioning system and an air-conditioning system controller that enable different temperature settings in two or more rooms.

DESCRIPTION OF EMBODIMENTS

Hereinafter, exemplary embodiments of the present disclosure will be described with reference to the accompanying drawings. Note that each of the exemplary embodiments described below shows one specific preferred example of the present disclosure. The numerical values, shapes, materials, structural elements, the arrangement and connection of the structural elements, steps, the processing order of the steps, etc., shown in the following exemplary embodiments are mere examples, and therefore do not limit the present disclosure. As such, among the structural elements in the following exemplary embodiments, structural elements not recited in any one of the independent claims which indicate the broadest concepts of the present disclosure are described as arbitrary structural elements. Furthermore, in the respective figures, substantially identical elements are assigned the same reference marks, and overlapping description is omitted or simplified.

First Exemplary Embodiment

Figure 1:
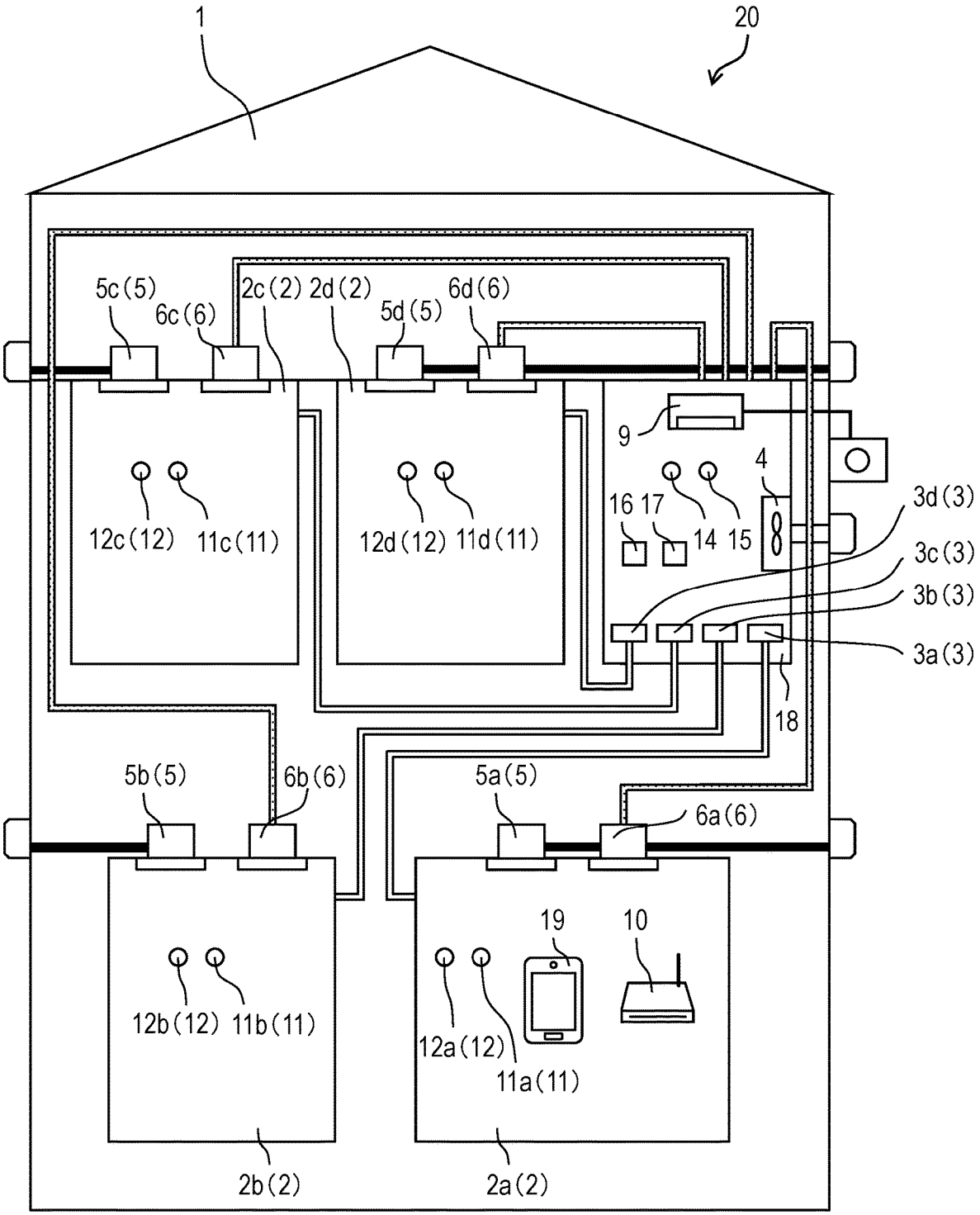
FIG. 1 is a schematic diagram of connection in an air-conditioning system according to the first exemplary embodiment of the present disclosure.

First, air-conditioning system 20 according to the first exemplary embodiment of the present disclosure will be described with reference to FIG. 1. FIG. 1 is a schematic diagram of connection in air-conditioning system 20 according to the present first exemplary embodiment.

Air-conditioning system 20 includes outside air inlet fan 4, a plurality of exhaust fans 5 (exhaust fans 5*a*, 5*b*, 5*c*, 5*d*), a plurality of delivery fans 3 (delivery fans 3*a*, 3*b*, 3*c*, 3*d*), a plurality of circulation fans 6 (circulation fans 6*a*, 6*b*, 6*c*, 6*d*), room temperature sensor 11 (room temperature sensors 11*a*, 11*b*, 11*c*, 11*d*), room humidity sensor 12 (room humidity sensors 12*a*, 12*b*, 12*c*, 12*d*), air-conditioning room temperature sensor 14, air-conditioning room humidity sensory 15, air conditioner 9, humidifier 16, dehumidifier 17, input/output terminal 19, and system controller 10 (corresponding to said air-conditioning system controller).

Air-conditioning system 20 is installed inside general house 1 which is an example of building. General house 1 includes a plurality of (in the present exemplary embodiment, four) rooms 2 (rooms 2*a*, 2*b*, 2*c*, 2*d*) and also includes at least one air-conditioning room 18 independent of rooms 2. Here, general house 1 (home) is a residence provided as a place where a resident conducts his or her private life; typical examples of rooms 2 include a living room, a dining room, a bedroom, a private room, and a children's room. The rooms provided by air-conditioning system 20 may include a water closet, a bathroom, a vanity unit, a dressing area, and so on.

In air-conditioning room 18, air delivered from rooms 2 is mixed up. Furthermore, outside air is drawn by outside air inlet fan 4 into air-conditioning room 18 and mixed up with the air delivered from rooms 2 by circulation fans 6. The temperature and the humidity of the air in air-conditioning room 18 are controlled using air conditioner 9, humidifier 16, and dehumidifier 17 installed in air-conditioning room 18, in other words, the air in air-conditioning room 18 is conditioned, and thus air to be delivered to rooms 2 is generated. The air conditioned in air-conditioning room 18 is delivered to rooms 2 by delivery fans 3.

The air in rooms 2 is not only delivered to air-conditioning room 18 by circulation fans 6, but also exhausted, as outside air, by exhaust fans 5 from rooms 2 to the outside of general house 1. Air-conditioning system 20 performs ventilation using the class 1 ventilation system by controlling the exhaust airflow of exhaust fans 5 to exhaust the air as outside air while controlling, in coordination with the exhaust airflow of exhaust fans 5, the supply airflow of outside air inlet fan 4 to draw outside air into the rooms.

Outside air inlet fan 4 draws outside air into the rooms in general house 1 and corresponds to an air supply fan, the air supply function of a heat exchanger fan, or the like. As mentioned above, the outside air drawn in by outside air inlet fan 4 is introduced into air-conditioning room 18. Outside air inlet fan 4 is configured so that the settings for the supply airflow thereof are available at multiple levels, and as described later, the exhaust airflow of outside air inlet fan 4 is set according to the exhaust airflow of exhaust fans 5.

Each of exhaust fans 5 exhausts, as outside air, a portion of the air in corresponding room 2, for example, through an exhaust duct, and corresponds to a ceiling ventilation fan, a wall mount ventilation fan, a range hood, the exhaust function of a heat exchanger fan, or the like. Note that in FIG. 1, the exhaust duct connected to exhaust fan 5 is directly led to the outside of general house 1, but in the case of using the exhaust function of a heat exchanger fan, the exhaust duct is connected to the heat exchanger fan before being led to the outside of general house 1. In other words, there is a heat exchange between air passing through the exhaust duct and air passing through an air supply path for the heat exchanger fan before the air is exhausted to the outside of general house 1. Exhaust fan 5*a* is provided in room 2*a*, exhaust fan 5*b* is provided in room 2*b*, exhaust fan 5*c* is provided in room 2*c*, and exhaust fan 5*d* is provided in room 2*d*.

Each of exhaust fans 5 is configured so that the settings for the exhaust airflow thereof are available at multiple levels. At a normal time, each of exhaust fans 5 is controlled to match the exhaust airflow thereof to a preset exhaust airflow. In addition, the exhaust airflow of each of exhaust fans 5*a* to 5*d* is controlled according to user settings or values obtained by various sensors, for example.

Delivery fans 3*a* to 3*d* are provided, for example, on a wall surface of air-conditioning room 18, to correspond to rooms 2*a* to 2*d*, respectively. The air in air-conditioning room 18 is delivered to room 2*a* by delivery fan 3*a* through a delivery duct, delivered to room 2*b* by delivery fan 3*b* through a delivery duct, delivered to room 2*c* by delivery fan 3*c* through a delivery duct, and delivered to room 2*d* by delivery fan 3*d* through a delivery duct. Note that the delivery ducts connected to the rooms are provided independently of each other.

Circulation fan 6*a* is provided in room 2*a*, circulation fan 6*b* is provided in room 2*b*, circulation fan 6*c* is provided in room 2*c*, and circulation fan 6*d* is provided in room 2*d*. A portion of the air in each of rooms 2*a* to 2*d* is delivered to air-conditioning room 18 by a corresponding one of circulation fans 6*a* to 6*d* through a circulation duct. Note that circulation ducts that connect air-conditioning room 18 and the rooms may be provided independently of each other, but a plurality of branch ducts each of which is a circulation duct portion may join together midway through into a single circulation duct which is connected to air-conditioning room 18.

Air-conditioner 9 corresponds to said air conditioner and controls air-conditioning in air-conditioning room 18. Air conditioner 9 cools or heats the air in air-conditioning room 18 to match the temperature of the air in air-conditioning room 18 to a preset target temperature (air-conditioning room target temperature).

When the humidity of the air in air-conditioning room 18 is lower than preset target humidity (air-conditioning room target humidity), humidifier 16 humidifies the air in air-conditioning room 18 to match the humidity thereof to the air-conditioning room target humidity. Note that although there are cases where humidifier 16 is embedded in air conditioner 9, humidifier 16 independent of air conditioner 9 is desirably used in order to provide sufficient humidifying power for the plurality of rooms 2.

When the humidity of the air in air-conditioning room 18 is higher than the preset target humidity (air-conditioning room target humidity), dehumidifier 17 dehumidifies the air in air-conditioning room 18 to match the humidity thereof to the air-conditioning room target humidity. Note that although there are cases where dehumidifier 17 is embedded in air conditioner 9, dehumidifier 17 independent of air conditioner 9 is desirably used in order to provide sufficient dehumidifying power for the plurality of rooms 2.

Room temperature sensor 11*a* is provided in room 2*a*, room temperature sensor 11*b* is provided in room 2*b*, room temperature sensor 11*c* is provided in room 2*c*, and room temperature sensor 11*d* is provided in room 2*d*. Room temperature sensors 11*a* to 11*d* obtain temperatures in corresponding rooms 2*a* to 2*d* and transmit the temperatures to system controller 10.

Room humidity sensor 12*a* is provided in room 2*a*, room humidity sensor 12*b* is provided in room 2*b*, room humidity sensor 12*c* is provided in room 2*c*, and room humidity sensor 12*d* is provided in room 2*d*. Room humidity sensor 12*a* to 12*d* obtains humidity in corresponding rooms 2*a* to 2*d* and transmits the humidity to system controller 10.

Air-conditioning room temperature sensor 14 obtains the temperature of air in air-conditioning room 18 and transmits the temperature to system controller 10. Note that air-conditioning room temperature sensor 14 may be embedded in air conditioner 9; in the case where air-conditioning room temperature sensor 14 is embedded in air conditioner 9, only information of an area around air conditioner 9 (for example, an area near an air supply port) can be obtained. In air-conditioning room 18, the outside air and the air delivered from each room 2 are mixed up as described above, and thus air-conditioning room temperature sensor 14 is desirably provided independently of air conditioner 9 so that information of the entire area in air-conditioning room 18 can be obtained.

Air-conditioning room humidity sensor 15 obtains the humidity of air in air-conditioning room 18 and transmits the temperature to system controller 10. Note that for the same reason as air-conditioning room temperature sensor 14, air-conditioning room humidity sensor 15 is desirably provided independently of air conditioner 9 so that information of the entire area in air-conditioning room 18 can be obtained.

System controller 10 controls the entirety of air-conditioning system 20. System controller 10 is wirelessly connected so as to be able to communicate with outside air inlet fan 4, exhaust fan 5, delivery fan 3, circulation fan 6, room temperature sensor 11, room humidity sensor 12, air-conditioning room temperature sensor 14, air-conditioning room humidity sensor 15, air conditioner 9, humidifier 16, and dehumidifier 17.

System controller 10 controls outside air inlet fan 4 and exhaust fan 5 in coordination, for example, by setting the supply airflow of outside air inlet fan 4 to an airflow corresponding to the exhaust airflow of exhaust fans 5. This allows ventilation using the class 1 ventilation system in general house 1.

Furthermore, on the basis of the temperature and the humidity of the air in air-conditioning room 18 obtained by air-conditioning room temperature sensor 14 and air-conditioning room humidity sensor 15, system controller 10 controls air conditioner 9, which serves as said air conditioner, humidifier 16, and dehumidifier 17 so that the temperature and/or the humidity in air-conditioning room 18 match the air-conditioning room target temperature and/or the air-conditioning room target humidity that have been set for air-conditioning room 18.

Moreover, system controller 10 sets the airflow of delivery fan 3 and the airflow of circulation fan 6 according to the temperature and/or the humidity in each room 2 obtained by room temperature sensor 11 and room humidity sensor 12 and the target temperature (room target temperature) and/or the target humidity (room target humidity), etc., that have been set for each of rooms 2*a* to 2*d*.

With this, the air conditioned in air-conditioning room 18 is delivered to each room 2 at the airflow rate that has been set for corresponding delivery fan 3, and the air in each room 2 is delivered to air-conditioning room 18 at the airflow rate that has been set for corresponding circulation fan 6. Thus, the temperature and/or the humidity in each room 2 is controlled to match the room target temperature and/or the room target humidity.

Here, since system controller 10 is wirelessly connected to outside air inlet fan 4, exhaust fan 5, delivery fan 3, circulation fan 6, room temperature sensor 11, room humidity sensor 12, air-conditioning room temperature sensor 14, air-conditioning room humidity sensor 15, air conditioner 9, humidifier 16, and dehumidifier 17, it is possible to eliminate the need for complex wiring work. However, all of these elements, or system controller 10 and some of these elements, may be configured to be able to communicate with each other by wired communication.

Input/output terminal 19 is wirelessly connected so as to be able to communicate with system controller 10, receives input of information required to build air-conditioning system 20, causes system controller 10 to store the information, obtains the state of air-conditioning system 20 from system controller 10, and displays the state of air-conditioning system 20, for example. Examples of input/output terminal 19 include mobile information terminals such as a cell phone, a smartphone, and a tablet.

Note that input/output terminal 19 does not necessarily need to be wirelessly connected to system controller 10 and may be connected so as to be able to communicate with system controller 10 by wired communication. In this case, input/output terminal 19 may be provided, for example, in the form of a wall mount remote controller.

Figure 2:
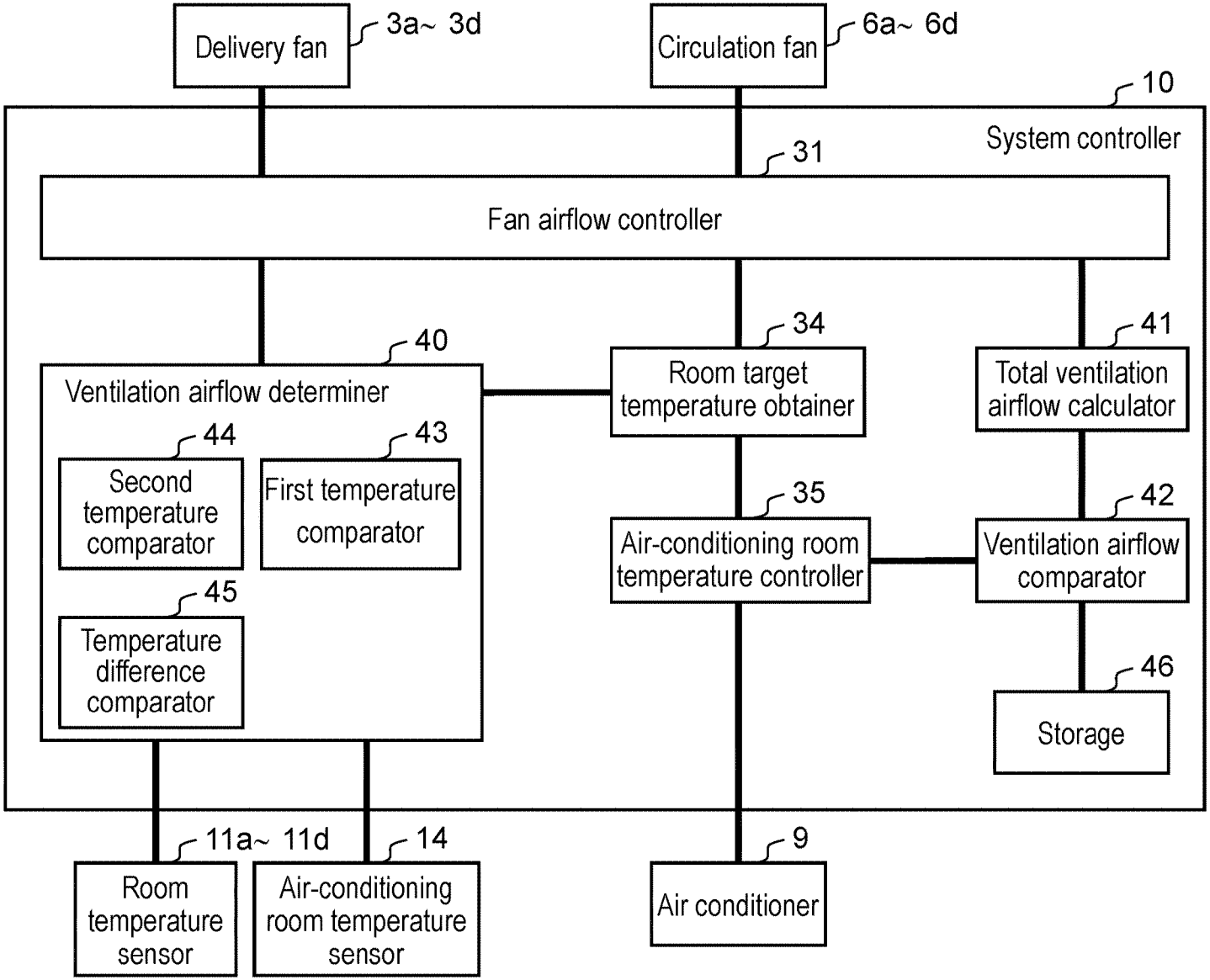
FIG. 2 is a schematic function block diagram of a system controller of an air-conditioning system.

Next, with reference to FIG. 2, each function of system controller 10 will be described. FIG. 2 is a schematic function block diagram of system controller 10.

System controller 10 includes room target temperature obtainer 34, air-conditioning room temperature controller 35, ventilation airflow determiner 40, fan airflow controller 31, total ventilation airflow calculator 41, ventilation airflow comparator 42, and storage 46.

Room target temperature obtainer 34 obtains a plurality of room target temperatures that have been set using input/output terminal 19 for each room 2.

Air-conditioning room temperature controller 35 controls air conditioner 9, which serves as said air conditioner, so that in a cooling period, that is, in the case where the temperature in room 2 (indoor temperature) is high and air conditioner 9 operates in a cooling mode, the temperature in air-conditioning room 18 (air-conditioning room temperature) becomes lower than or equal to the lowest one of the plurality of room target temperatures obtained by room target temperature obtainer 34. Air-conditioning room temperature controller 35 controls air conditioner 9 so that in a heating period, that is, in the case where the temperature in room 2 is low and air conditioner 9 operates in a heating mode, the temperature in air-conditioning room 18 becomes higher than or equal to the highest one of the plurality of room target temperatures obtained by room target temperature obtainer 34.

Ventilation airflow determiner 40 includes first temperature comparator 43, second temperature comparator 44, and temperature difference comparator 45. Ventilation airflow determiner 40 determines the airflow of each delivery fan 3 on the basis of the room target temperature obtained by room target temperature obtainer 34, the temperature in air-conditioning room 18 controlled by air-conditioning room temperature controller 35, and the temperature in the corresponding room that has been obtained by room temperature sensor 11. Note that the procedures for determining and changing the airflow will be described later.

First temperature comparator 43 calculates, for each room, a temperature difference between the room target temperature obtained by room target temperature obtainer 34 and the temperature in the air-conditioning room 18 that has been detected by air-conditioning room temperature sensor 14.

Second temperature comparator 44 calculates, for each room, a temperature difference between the room target temperature obtained by room target temperature obtainer 34 and the temperature in the room that has been detected by room temperature sensor 11.

Temperature difference comparator 45 compares temperature difference A calculated by second temperature comparator 44 at predetermined timing A and temperature difference B calculated by second temperature comparator 44 at timing B at which a predetermined length of time has elapsed since predetermined timing A. To put it differently, timing A is a predetermined time, and timing B is a time at which a predetermined length of time has elapsed since the predetermined time.

Fan airflow controller 31 controls the airflow of each of the plurality of delivery fans 3*a* to 3*d*, which are provided for the plurality of rooms 2*a* to 2*d* in one-to-one correspondence, so that the airflow matches the airflow of a corresponding one of delivery fans 3*a* to 3*d* that has been determined by ventilation airflow determiner 40. Furthermore, fan airflow controller 31 may control circulation fans 6*a* to 6*d*, but detailed description is omitted herein.

Total ventilation airflow calculator 41 calculates a total ventilation airflow that is a sum of the ventilation airflows of the plurality of delivery fans 3*a* to 3*d*. Here, the sum of the ventilation airflows is represented as the summation of per-unit-time ventilation airflows of delivery fans 3*a* to 3*d*.

Ventilation airflow comparator 42 compares a predetermined ventilation airflow threshold value and the total ventilation airflow calculated by total ventilation airflow calculator 41. Here, the predetermined ventilation airflow threshold value may be, for example, the sum of the maximum ventilation airflows of the plurality of delivery fans 3*a* to 3*d* or the value of 70% to 95% of the sum of these maximum ventilation airflows.

Storage 46 is what is called memory which stores the predetermined ventilation airflow threshold value that is set in advance. In addition, storage 46 is also used in the case where information such as numerical values needs to be stored for control of system controller 10.

Figure 3:
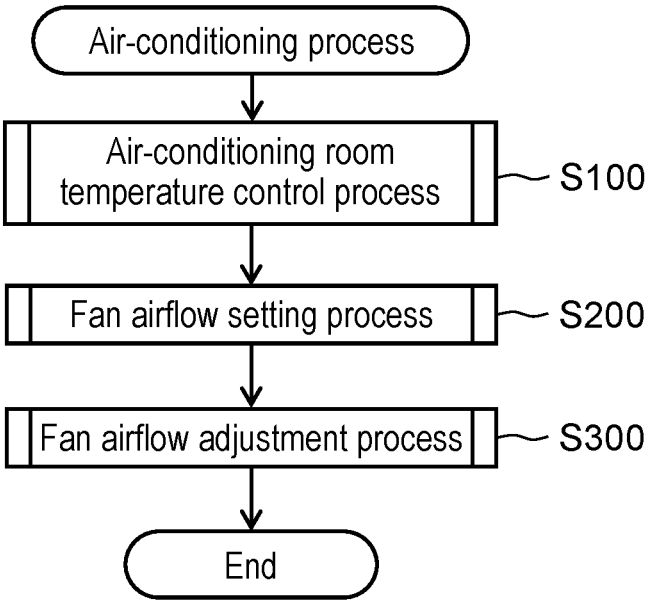
FIG. 3 is a flowchart illustrating an air-conditioning process.
Figure 4:
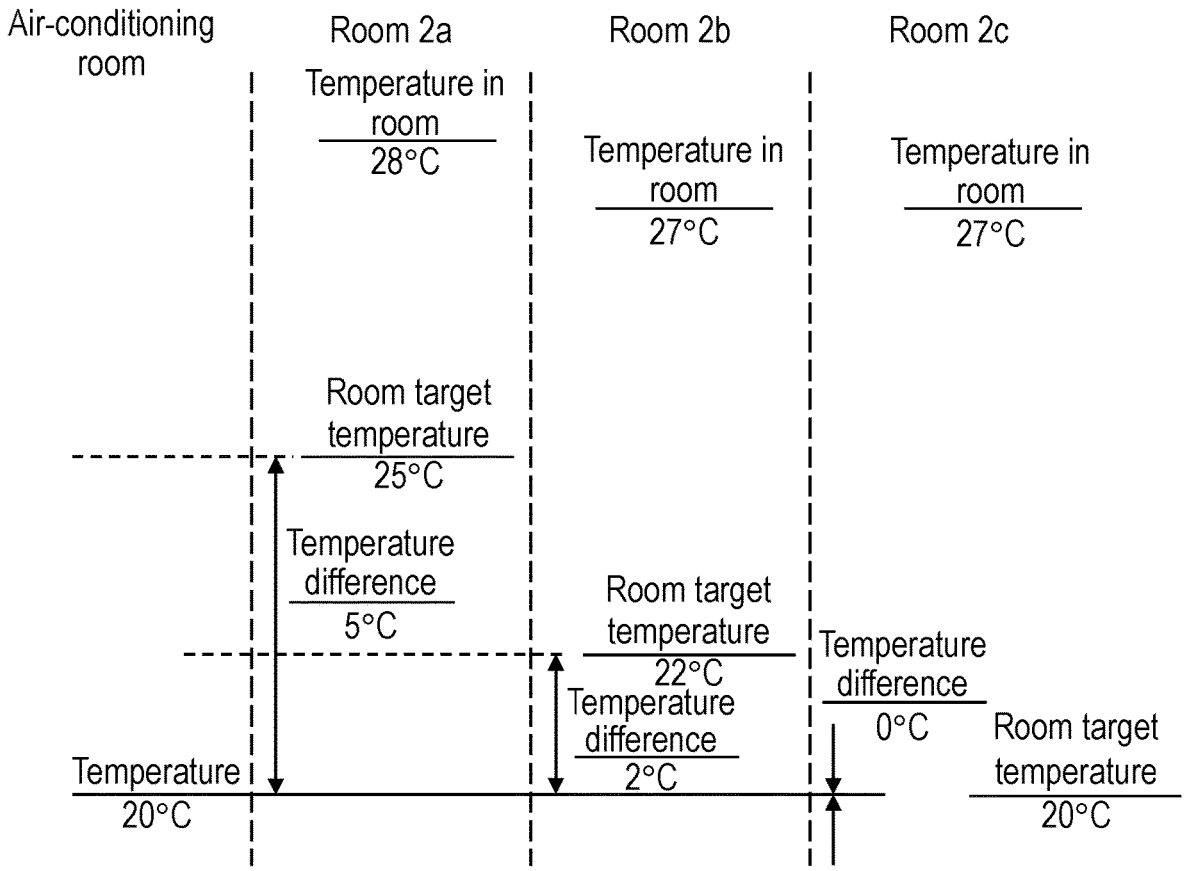
FIG. 4 is a diagram illustrating one example of the relationship between a temperature in an air-conditioning room, a temperature in a room, and a room target temperature.
Figure 5:
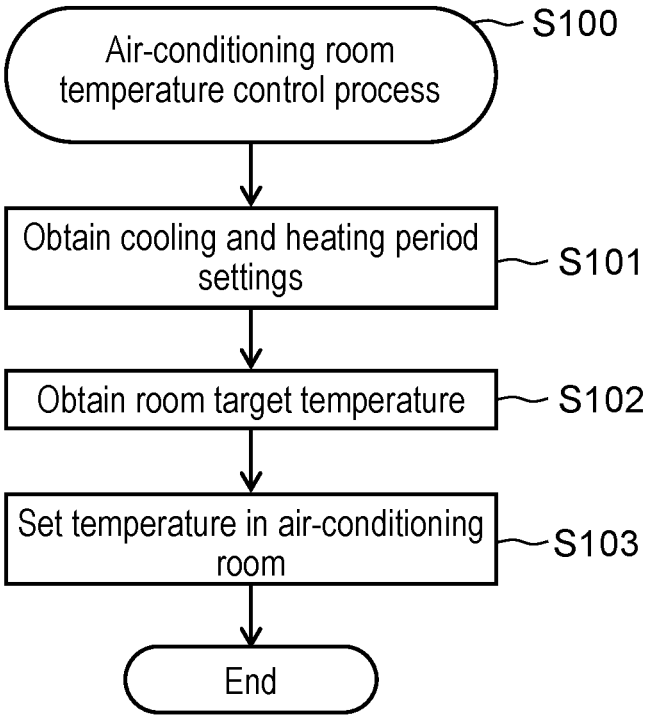
FIG. 5 is a flowchart illustrating an air-conditioning room temperature control process.
Figure 6:
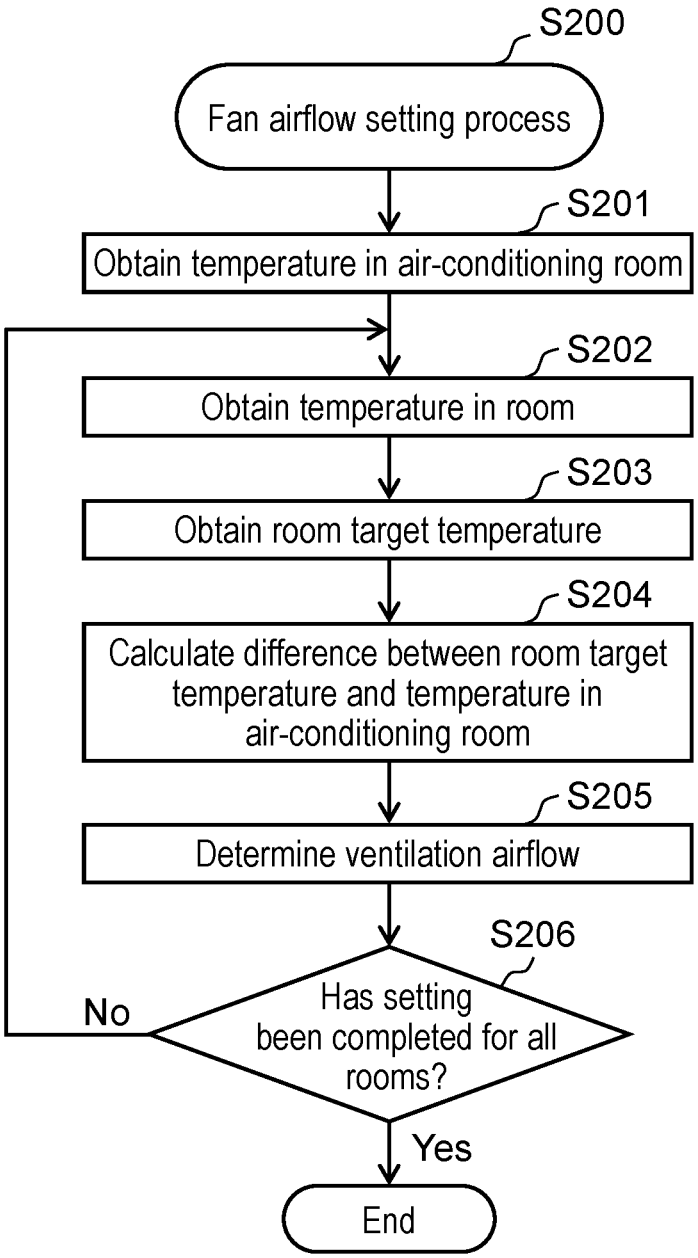
FIG. 6 is a flowchart illustrating a fan airflow setting process.
Figure 7:
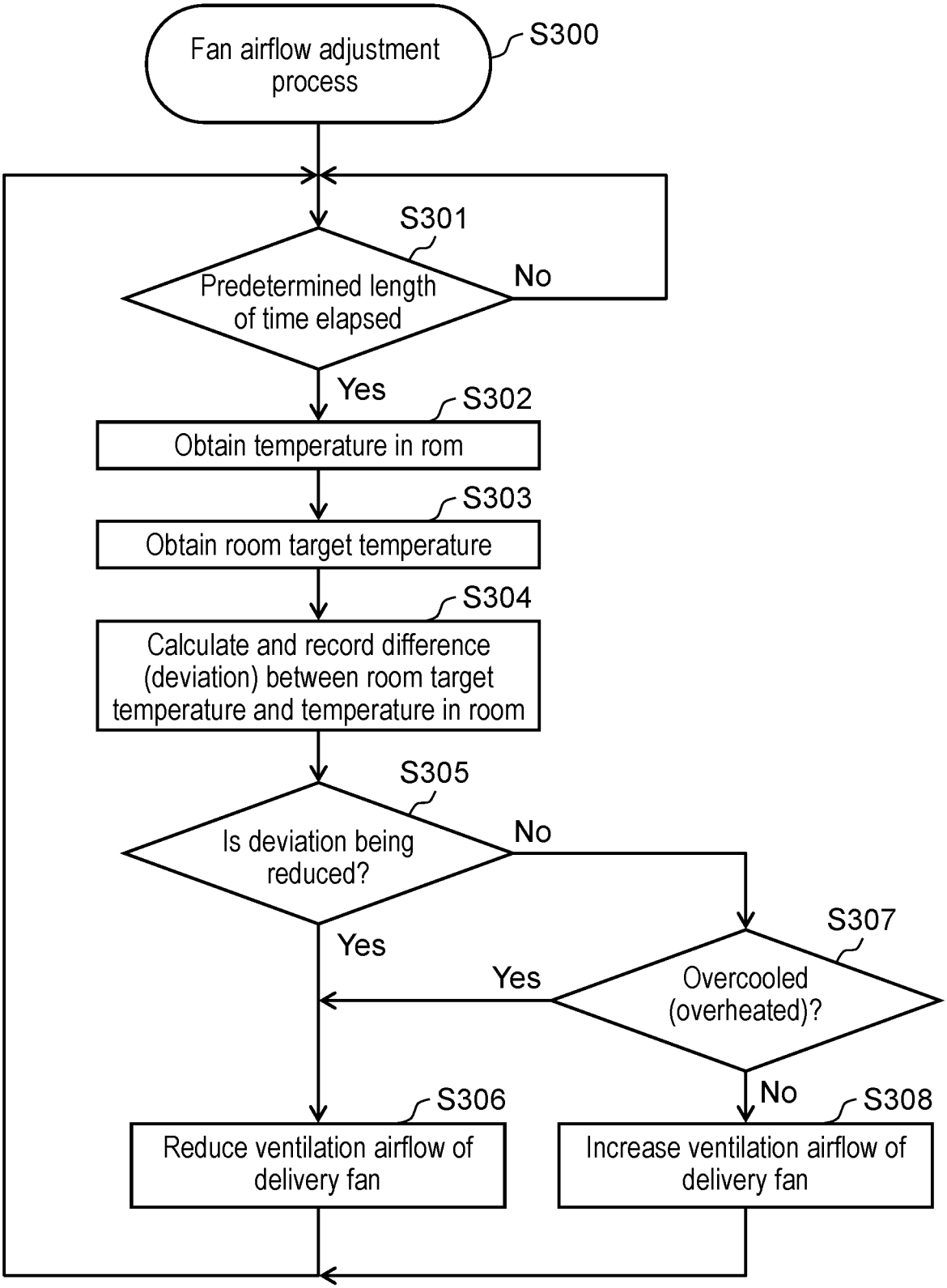
FIG. 7 is a flowchart illustrating a fan airflow adjustment process.

Next, with reference to FIG. 3 to FIG. 7, the air-conditioning process performed by system controller 10 will be described. FIG. 3 is a flowchart illustrating the air-conditioning process. FIG. 4 is a diagram illustrating one example of the relationship between the temperature in the air-conditioning room, the temperature in a room, and the room target temperature. FIG. 5 is a flowchart illustrating an air-conditioning room temperature control process. FIG. 6 is a flowchart illustrating a fan airflow setting process. FIG. 7 is a flowchart illustrating a fan airflow adjustment process.

As illustrated in FIG. 3, the air-conditioning process performed by system controller 10 primarily includes air-conditioning room temperature control process S100, fan airflow setting process S200, and fan airflow adjustment process S300; these processes are performed in this order.

When a user executes the air-conditioning process, first, system controller 10 performs air-conditioning room temperature control process S100 illustrated in FIG. 5. In air-conditioning room temperature control process S100, system controller 10 obtains cooling and heating period settings configured by input/output terminal 19 (S101). Here, in the cooling and heating period settings, for example, a summer season in which the atmospheric temperature is high and air conditioner 9 operates (runs) as a cooler is set as a cooling period, and a winter season in which the atmospheric temperature is low and air conditioner 9 operates as a heater is set as a heating period. A user sets, for example, June to September as the cooling period, and December to March as the heating period, in the calendar function of input/output terminal 19, and system controller 10 is capable of obtaining these settings.

Next, system controller 10 obtains the plurality of room target temperatures set for rooms 2*a* to 2*d* in one-to-one correspondence by input/output terminal 19 via room target temperature obtainer 34 (S102).

When the room target temperatures are obtained, air-conditioning room temperature controller 35 sets, in air conditioner 9, the target temperature for air-conditioning room 18 (air-conditioning room target temperature) (S103). Specifically, the air-conditioning room target temperature is determined as follows.

FIG. 4 illustrates an example of a temperature environment in the air-conditioning room 18 and rooms 2*a*, 2*b*, 2*c*. The temperature in room 2*a* is 28° C., and the room target temperature for room 2*a* is 25° C. The temperature in room 2*b* is 27° C., and the room target temperature for room 2*b* is 22° C. The temperature in room 2*c* is 27° C., and the room target temperature for room 2*c* is 20° C. Here, since the cooling and heating period settings obtained in S101 indicate the cooling period, that is, the operation in the cooling mode, air-conditioning room temperature controller 35 controls the air-conditioning room target temperature so that the air-conditioning room target temperature becomes lower than or equal to the lowest one of the plurality of room target temperatures. Specifically, in the example illustrated in FIG. 4, the plurality of room target temperatures are compared, and the air-conditioning room target temperature is set lower than or equal to 20° C. that is the lowest room target temperature. Here, assume that the air-conditioning room target temperature is 20° C.

Note that in the heating period, that is, during the operation in the heating mode, air-conditioning room temperature controller 35 controls the air-conditioning room target temperature so that the air-conditioning room target temperature becomes higher than or equal to the highest one of the plurality of room target temperatures. Although an example such as that in FIG. 4 is not given in the drawings, the preset temperature in the heating period is, for example, 23° C.

With the above settings, air-conditioning room 18 is cooled down to the preset temperature, i.e., 20° C.; this air-conditioning room target temperature can be applied to deal with the room target temperatures for all rooms 2 (in this example, 20° C. to 25° C.).

Next, system controller 10 performs fan airflow setting process S200 illustrated in FIG. 6. In fan airflow setting process S200, system controller 10 obtains the air-conditioning room temperature via air-conditioning room temperature sensor 14 (S201). Subsequently, system controller 10 obtains the temperature in each room via room temperature sensor 11 (S202). Furthermore, system controller 10 obtains the plurality of room target temperatures set for rooms 2*a* to 2*d* in one-to-one correspondence by input/output terminal 19 via room target temperature obtainer 34 (S203).

When the obtainment is completed, first temperature comparator 43 compares the room target temperature and the air-conditioning room temperature and calculates a temperature difference (S204).

When first temperature comparator 43 calculates the temperature difference, ventilation airflow determiner 40 determines the ventilation airflow of each of delivery fans 3*a* to 3*d* on the basis of the calculated temperature difference.

The ventilation airflow is determined specifically as follows. Since the room target temperature for room 2*c* is 20° C. and the temperature in air-conditioning room 18 that has been air-conditioned under control is 20° C., the ventilation airflow of delivery fan 3*c* corresponding to a delivery duct connecting room 2*c* and air-conditioning room 18 is set to the maximum value. Here, the ventilation airflow can be an operation notch or the ventilation capability of the delivery fan. For example, the ventilation airflow of delivery fan 3 can be set at ten levels, namely, ventilation airflow 1 to ventilation airflow 10 in the ascending order of ventilation airflow; in this example, ventilation airflow 10 is determined as the ventilation airflow. In other words, ventilation airflow determiner 40 determines the ventilation airflow so that, in order to reduce the temperature in room 2*c* from 27° C. and furthermore maintain the temperature at the room target temperature that is 20° C., air of the same temperature as in air-conditioning room 18 (20° C.) is blown at the maximum airflow rate.

Furthermore, for example, since the room target temperature for room 2*b* is 22° C. and the temperature in air-conditioning room 18 that has been air-conditioned under control is 20° C., if the ventilation capability of delivery fan 3*b* is airflow 10 which is the maximum value, the room target temperature for room 2*b* may fall below the room target temperature that is 22° C. Thus, ventilation airflow determiner 40 sets the ventilation airflow of delivery fan 3*b* to a value less than the maximum value. The value less the maximum value is, for example, ventilation airflow 8. Similarly, since the room target temperature for room 2*a* is 25° C. and the temperature in air-conditioning room 18 that has been air-conditioned under control is 20° C., if the ventilation capability of delivery fan 3*a* is airflow 10 which is the maximum value, the room target temperature for room 2*a* may fall below the room target temperature that is 25° C. Thus, ventilation airflow determiner 40 sets the ventilation airflow of delivery fan 3*a* to a value less than the maximum value, for example, ventilation airflow 5.

In other words, according to the difference between the room target temperature and the temperature in the air-conditioning room, ventilation airflow determiner 40 makes the ventilation airflow of delivery fan 3*c* for a room for which the temperature difference calculated by first temperature comparator 43, for example, is small (room 2*c* for which the temperature difference is 0° C.) greater than the ventilation airflow of the delivery fan for a room for which the temperature difference is large (for example, room 2*a* for which the temperature difference is 5° C. and room 2*b* for which the temperature difference is 2° C.).

The above processing is performed on all the rooms including room 2*d* (No in S206 is directed to S202 and eventually to Yes in S206).

When ventilation airflow determiner 40 determines the airflow of each delivery fan 3, fan airflow controller 31 controls each delivery fan 3 according to the result of the determination.

Thus, with the temperature in air-conditioning room 18 controlled by air-conditioning room temperature controller 35 and the independent control on each of the plurality of delivery fans 3*a* to 3*d*, it is possible to control each room so that the room has a corresponding room target temperature.

Note that it is possible to first blow air into a room having a temperature lower than the room target temperature at the maximum airflow rate regardless of the difference between the temperature in the room and the room target temperature so that the temperature in the room can quickly reach the room target temperature. Even in this case, each room can be maintained at the corresponding room target temperature through fan airflow adjustment process S300 to be described later. However, since air-conditioning room 18 delivers air into the plurality of rooms 2, if there is a need to deliver a large amount of air at a time, the cooling and heating processes of air-conditioning room 18 will not suffice, in other words, the cooling and heating effects are reduced. This is the case, for example, upon the start of the processing of the air-conditioning system or upon setting the room target temperature for the rooms low at the same time by family members after returning their empty home. In order to address this matter, the volume of the air-conditioning room may be increased, but this solution causes an increase in spatial cost and in addition, generates the need for larger air conditioner capacity. In contrast, ventilation airflow determiner 40 makes the ventilation airflow of the delivery fan for a room having a small temperature difference greater than the ventilation airflow of the delivery fan for a room having a large temperature difference. In other words, ventilation airflow determiner 40 makes the ventilation airflow of the delivery fan for a room having a large temperature difference less than the ventilation airflow of the delivery fan for a room having a small temperature difference. Thus, by gradually reducing the temperature in each room toward the corresponding room target temperature, a reduction in the cooling and heating effects is suppressed, resulting in downsizing of the air-conditioning room.

With the above settings, since the room target temperature for room 2*c* is 20° C. that is equal to the temperature in air-conditioning room 18, for example, it is possible to control room 2*c* to have the room target temperature by controlling delivery fan 3*c* to operate at the maximum airflow rate. However, if ventilation airflow 5 in the above example is applied to room 2*a* having a room target temperature of 25° C., for example, it is unknown whether the temperature in room 2*a* can reach the room target temperature or whether the temperature in room 2*a* can be maintained at the room target temperature after reaching the room target temperature or whether room 2*a* is overcooled. The same holds true for room 2*b*. In order to deal with such a situation, system controller 10 performs fan airflow adjustment process S300 illustrated in FIG. 7. In fan airflow adjustment process S300, system controller 10 determines whether a predetermined length of time has elapsed since the end of fan airflow setting process S200 (S301). When the predetermined length of time has not elapsed, system controller 10 remains on standby until the predetermined length of time is elapsed (No in S301). This is to secure time for allowing the air-conditioning system to operate in an environment set in fan airflow setting process S200 and causing the temperature in each room to approach the corresponding room target temperature.

After the predetermined length of time has elapsed, system controller 10 obtains the temperature in each room via room temperature sensor 11 (S302). Furthermore, system controller 10 obtains the plurality of room target temperatures set for rooms 2*a* to 2*d* in one-to-one correspondence by input/output terminal 19 via room target temperature obtainer 34 (S303).

When the obtainment is completed, second temperature comparator 44 compares the room target temperature and the temperature in the room and calculates a temperature difference (deviation in temperature) (S304).

When second temperature comparator 44 calculates the temperature difference, temperature difference comparator 45 compares the calculated temperature difference with temperature difference A calculated by the second temperature comparator 44 at the last timing (corresponding to timing A) and stored in the last round of fan airflow adjustment process S300. Since this is the first process and temperature difference A calculated at the last timing is absent, the temperature difference calculated without the comparison is stored into storage 46 as temperature difference A, and the processing returns to the process in S301.

Note that when there is temperature difference A calculated at the last timing (timing A), temperature difference comparator 45 compares temperature difference B calculated by second temperature comparator 44 at this timing (corresponding to timing B) and temperature difference A calculated at timing A and stored in storage 46.

Here, a reduction in the deviation of the temperature in the room from the room target temperature as a result of the time transition from timing A to timing B, that is, temperature difference B being smaller than temperature difference A, means that the temperature in the room approaches the room target temperature through the operation of delivery fan 3. Thus, ventilation airflow determiner 40 reduces the ventilation airflow of delivery fan 3 (Yes in S305 is directed to S306).

When the deviation of the temperature in the room from the room target temperature no longer exists or increases as a result of the time transition from timing A to timing B, that is, when temperature difference B is larger than temperature difference A, overcooling (in the case of the cooling period) or overheating (in the case of the heating period) is determined (S307). This means that when the deviation increases, either of the following cases is conceivable: the ventilation airflow of delivery fan 3 is too large, and cooling (heating) beyond the room target temperature is performed (excessive process); and the ventilation airflow of delivery fan 3 is too small for the temperature in the room to approach the room target temperature and furthermore, the temperature in the room is away from the room target temperature due to the effects of outside air. Thus, these are determined in S307.

Here, when the overcooling or the overheating is determined, in other words, it is determined that the excessive process is underway, ventilation airflow determiner 40 reduces the ventilation airflow of the delivery fan (Yes in S307 is directed to S306).

When the overcooling or the overheating is not determined, in other words, it is determined that the excessive process is not underway, ventilation airflow determiner 40 increases the ventilation airflow of the delivery fan (No in S307 is directed to S308).

According to the cooling and heating period settings, the room target temperature, and the temperature in the room, it is possible to make the above-described determination as to whether or not the operation is the overcooling (overheating) (whether or not the excessive process is underway).

Note that although not illustrated in FIG. 7, when there is no deviation as a result of the time transition from timing A to timing B and the temperature in the room is in the range near the room target temperature (for example, plus/minus 0.3° C.), the ventilation airflow of delivery fan can be maintained without changes.

Fan airflow adjustment process S300 described above is performed in a given interval of time.

Through fan airflow adjustment process S300 described above, the temperature in each room can reach a corresponding room target temperature and be maintained at the room target temperature by way of the control of air-conditioning room temperature controller 35 on the temperature in the air-conditioning room 18 and the control on the ventilation airflow of delivery fan 3.

Particularly, the temperature in air-conditioning room 18 changes a lot because air of various temperatures flows in from the plurality of rooms using circulation fan 6 and the like. Therefore, controlling the temperature by a system or the like that uses a difference in air pressure and a damper is difficult; thus, it is important to use delivery fan 3 to blow air. Note that in the above-described processing, the temperature control is possible even when a general fan is used as the delivery fan, but a fan including a constant airflow control function part capable of maintaining the ventilation airflow at a preset constant level without being affected by a duct length or pressure is preferably used as the delivery fan in order to enable fine temperature control.

Note that when the process of changing the settings of room target temperatures or switching between the cooling and heating periods, for example, is performed as interrupt processing, it is possible to apply the changes in the settings by beginning the above-described air-conditioning process from air-conditioning room temperature control process S100.

Air-conditioning room 18 is a space having a limited volume; for example, when there arises the need to cool or heat all rooms 2*a* to 2*d* with maximum ventilation airflow 10, maintaining the temperature in air-conditioning room 18 becomes difficult. This is due to a large amount of air having an adjusted temperature flowing out of air-conditioning room 18 whereas a large amount of air having a temperature relatively significantly different than the preset temperature for air-conditioning room 18 flows into air-conditioning room 18.

Figure 8:
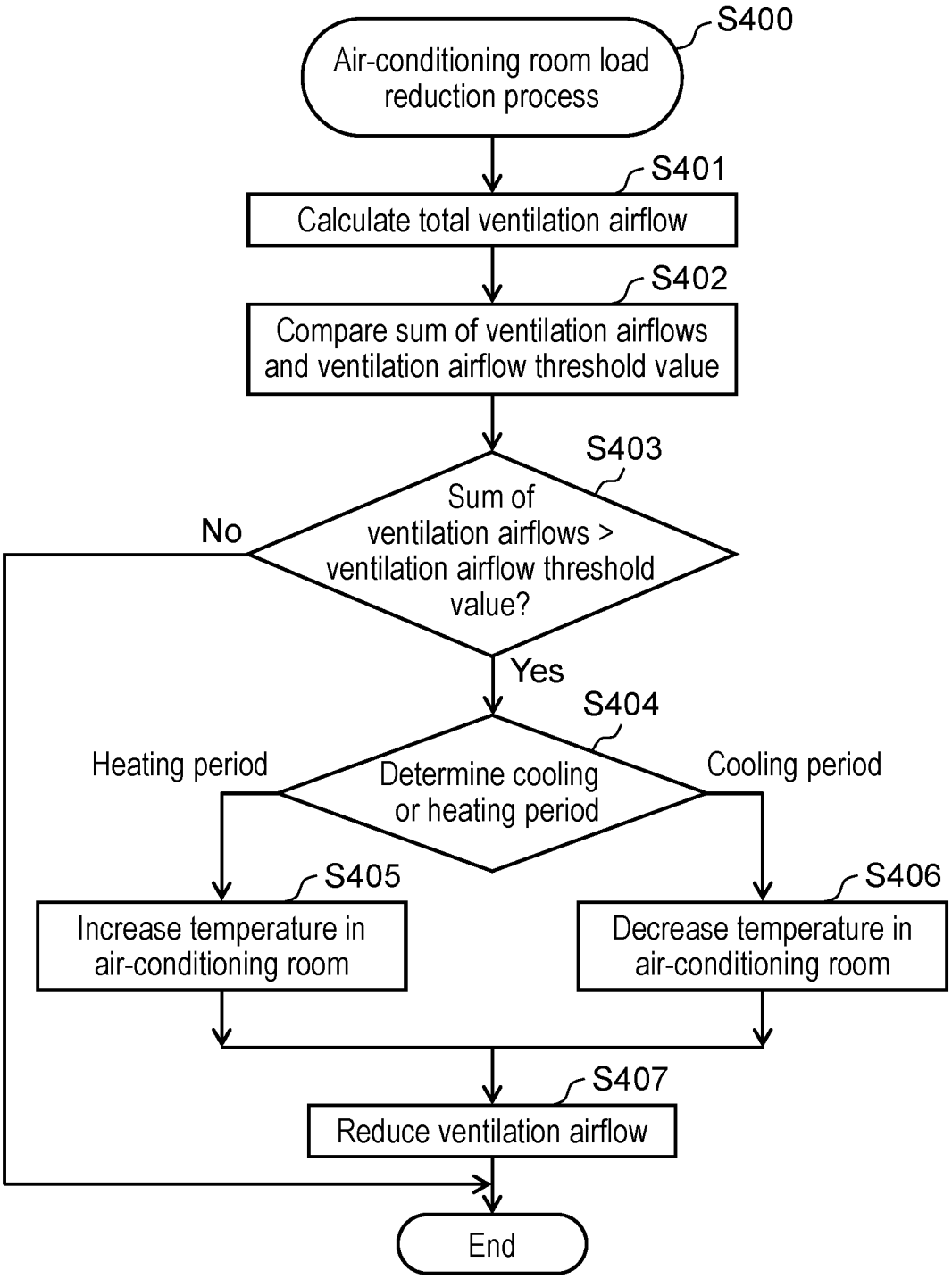
FIG. 8 is a flowchart illustrating an air-conditioning room load reduction process.

Therefore, in order to address such a situation, system controller 10 may perform air-conditioning room load reduction process S400 (refer to FIG. 8). Air-conditioning room load reduction process S400 is performed as interrupt processing in air-conditioning room temperature setting S103, for example. In air-conditioning room load reduction process S400, total ventilation airflow calculator 41 calculates a total ventilation airflow that is a sum of the ventilation airflows of the plurality of delivery fans 3*a* to 3*d* (S401). Next, ventilation airflow comparator 42 compares the total ventilation airflow calculated by total ventilation airflow calculator 41 and the predetermined ventilation airflow threshold value stored in storage 46 in advance (S402). Here, the predetermined ventilation airflow threshold value is the value of 80% of the sum of the maximum ventilation airflows of the plurality of delivery fans 3*a* to 3*d*.

When the sum of the ventilation airflows exceeds the predetermined ventilation airflow threshold value, ventilation airflow comparator 42 further obtains the cooling and heating period settings that have been set at input/output terminal 19, and determines the cooling or heating period on the basis of this information (Yes in S403 is directed to S404). Ventilation airflow comparator 42 transmits, to air-conditioning room temperature controller 35, information indicating that the sum of the ventilation airflows exceeds the predetermined ventilation airflow threshold value and that the current period is the cooling period or the heating period.

Air-conditioning room temperature controller 35 receives the information indicating that the sum of the ventilation airflows exceeds the predetermined ventilation airflow threshold value and that the current period is the cooling period or the heating period, and in the cooling period, changes the air-conditioning room temperature from the current settings to a less value (cooling period in S404 is directed to S406). In the heating period, air-conditioning room temperature controller 35 changes the air-conditioning room temperature from the current settings to a greater value (heating period in S404 is directed to S405).

Air-conditioning room temperature controller 35 transmits, to ventilation airflow determiner 40, information indicating that the settings of the air-conditioning room temperature have been changed, and ventilation airflow determiner 40 reduces the ventilation airflow of delivery fan 3 on the basis of this information (S407).

Thus, by changing the temperature settings of air-conditioning room 18 to a less value (in the cooling period) or a greater value (in the heating period), it is possible to cover a wide temperature range of the room target temperature without increasing the limited volume of air-conditioning room 18.

In term of efficient use and energy consumption of air-conditioning room 18, it is advantageous if the ranges of reduction (in the cooing period) and increase (in the heating period) of the air-conditioning room temperature are not fixed values, but increase in proportion to the excess of the sum of the ventilation airflows above the predetermined ventilation airflow threshold value. Specifically, when the predetermined ventilation airflow threshold value is 70 and the sum of the ventilation airflows is 80, the temperature changes by 2° C. In this case, when the sum of the ventilation airflows is 90, the temperature changes by 4° C., and when the sum of the ventilation airflows is 100, the temperature changes by 6° C.

Note that when the sum of the ventilation airflows does not exceed the predetermined ventilation airflow threshold value, the air-conditioning room load reduction process S400 ends without changing the air-conditioning room temperature or reducing the ventilation airflow (No in S403 is directed to END).

The air-conditioning system and the system controller according to the present disclosure have been described above, but the above-described exemplary embodiment is a mere example, and the present disclosure is not limited to this example.

For example, circulation fans 6*a* to 6*d* and delivery fans 3*a* to 3*d* are in communication via ducts connecting the air-conditioning room and the rooms. However, circulation fans 6*a* to 6*d* do not necessarily need to be connected via the ducts, and the space connecting the rooms such as a corridor can be regarded as the ducts. In this case, circulation fans 6*a* to 6*d* deliver air inside the rooms from the rooms into the corridor. The air inside the rooms that has been delivered to the corridor is drawn into air-conditioning room 18 which is in communication with the corridor. In order to draw the air into air-conditioning room 18, a circulation fan may further be provided on a wall surface of air-conditioning room 18 that faces the corridor, or negative pressure may be generated in the air-conditioning room so that the air can be drawn in without the use of the circulation fan. Even such a configuration can contribute to the air-conditioning system although the circulation efficiency is expected to be lower than that in the case of the connection via the ducts.

The rooms described in the above exemplary embodiment do not necessarily need to accommodate persons and may be regarded as one space. This means that a corridor, a kitchen, or the like that is somewhat segmented can be regarded as one space and corresponds to one room.

The air-conditioning system according to the present disclosure is applicable to an independent house and a housing complex such as a condominium. Note that when the air-conditioning system is applied to a housing complex, a single system is used for each unit, meaning that it is not that each unit is regarded as one room.

INDUSTRIAL APPLICABILITY

The air-conditioning system according to the present disclosure is useful as an air-conditioning system and an air conditioning system controller that enable efficient central air-conditioning.

REFERENCE MARKS IN THE DRAWINGS

1 general house
2, 2*a*, 2*b*, 2*c*, 2*d* room
3, 3*a*, 3*b*, 3*c*, 3*d* delivery fan
4 outside air inlet fan
5, 5*a*, 5*b*, 5*c*, 5*d* exhaust fan
6, 6*a*, 6*b*, 6*c*, 6*d* circulation fan

9 air conditioner
10 system controller
11, 11*a*, 11*b*, 11*c*, 11*d* room temperature sensor
12, 12*a*, 12*b*, 12*c*, 12*d* room humidity sensor
14 air-conditioning room temperature sensor
15 air-conditioning room humidity sensor
16 humidifier
17 dehumidifier
18 air-conditioning room
19 input/output terminal
20 air-conditioning system
31 fan airflow controller
34 room target temperature obtainer
35 air-conditioning room temperature controller
40 ventilation airflow determiner
41 total ventilation airflow calculator
42 ventilation airflow comparator
43 first temperature comparator
44 second temperature comparator
45 temperature difference comparator
46 storage

The invention claimed is:

1. An air-conditioning system, comprising:

an air conditioner which is installed in an air-conditioning room and conditions air in the air-conditioning room;

a plurality of delivery fans which are installed for a plurality of rooms in one-to-one correspondence and deliver the air in the air-conditioning room into the plurality of rooms, the plurality of rooms being independent of the air-conditioning room;

a system controller which controls the air conditioner and the plurality of delivery fans;

a room temperature sensor which obtains a temperature in each of the plurality of rooms and transmits the temperature in each of the plurality of rooms to the system controller; and an air-conditioning room temperature sensor which obtains a temperature in the air-conditioning room and transmits the temperature in the air-conditioning room to the system controller, wherein the system controller includes:

a room target temperature obtainer which obtains a plurality of room target temperatures set for the plurality of rooms in one-to-one correspondence;

an air-conditioning room temperature controller which controls the temperature in the air-conditioning room by causing the air-conditioning room to have a temperature lower than or equal to a lowest one of the plurality of target temperatures when the air conditioner operates in a cooling mode, and causing the air-conditioning room to have a temperature higher than or equal to a highest one of the plurality of target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by the room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the ventilation airflow determiner includes:

a temperature comparator which calculates a temperature difference by comparing each of the plurality of room target temperatures obtained by the room target temperature obtainer and the temperature in the air-conditioning room obtained by the air-conditioning room temperature sensor, and the ventilation airflow determiner determines the ventilation airflow of each of the plurality of delivery fans on the basis of the temperature difference calculated by the temperature comparator.

2. The air-conditioning system according to claim 1, wherein the ventilation airflow determiner makes the ventilation airflow of one of the plurality of delivery fans that is installed for a room for which the temperature difference calculated by the temperature comparator is small greater than the ventilation airflow of one of the plurality of delivery fans that is installed for a room for which the temperature difference calculated by the temperature comparator is large.

3. An air-conditioning system, comprising:

an air conditioner which is installed in an air-conditioning room and conditions air in the air-conditioning room;

a plurality of delivery fans which are installed for a plurality of rooms in one-to-one correspondence and deliver the air in the air-conditioning room into the plurality of rooms, the plurality of rooms being independent of the air-conditioning room;

a system controller which controls the air conditioner and the plurality of delivery fans;

a room temperature sensor which obtains a temperature in each of the plurality of rooms and transmits the temperature in each of the plurality of rooms to the system controller; and an air-conditioning room temperature sensor which obtains a temperature in the air-conditioning room and transmits the temperature in the air-conditioning room to the system controller, wherein the system controller includes:

a room target temperature obtainer which obtains a plurality of room target temperatures set for the plurality of rooms in one-to-one correspondence;

an air-conditioning room temperature controller which controls the temperature in the air-conditioning room by causing the air-conditioning room to have a temperature lower than or equal to a lowest one of the plurality of target temperatures when the air conditioner operates in a cooling mode, and causing the air-conditioning room to have a temperature higher than or equal to a highest one of the plurality of target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by the room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the ventilation airflow determiner includes:

a temperature comparator which calculates a temperature difference by comparing each of the plurality of room target temperatures obtained by the room target temperature obtainer and the temperature in a corresponding one of the plurality of rooms obtained by the room temperature sensor; and a temperature difference comparator which compares a temperature difference A calculated by the temperature comparator at predetermined timing A and a temperature difference B calculated by the temperature comparator at timing B at which a predetermined length of time has elapsed since the predetermined timing A, and in response to a result of the comparison of the temperature difference comparator, the ventilation airflow determiner changes the ventilation airflow of each of the plurality of delivery fans to reduce a deviation of the temperature in a corresponding one of the plurality of rooms from a corresponding one of the plurality of room target temperatures.

4. The air-conditioning system according to claim 3, wherein in response to the result of the comparison of the temperature difference comparator, when the temperature difference B is smaller than the temperature difference A, the ventilation airflow determiner reduces the ventilation airflow of a corresponding one of the plurality of delivery fans.

5. The air-conditioning system according to claim 3, wherein in response to the result of the comparison of the temperature difference comparator, when the temperature difference B is larger than the temperature difference A, the ventilation airflow determiner further determines whether an excessive process in which the ventilation airflow of a corresponding one of the plurality of delivery fans is too large is underway, when a result of the determination indicates that the excessive process is underway, the ventilation airflow determiner reduces the ventilation airflow of the corresponding one of the plurality of delivery fans, and when the result of the determination indicates that the excessive process is not underway, the ventilation airflow determiner increases the ventilation airflow of the corresponding one of the plurality of delivery fans.

6. An air-conditioning system, comprising:

an air conditioner which is installed in an air-conditioning room and conditions air in the air-conditioning room;

a plurality of delivery fans which are installed for a plurality of rooms in one-to-one correspondence and deliver the air in the air-conditioning room into the plurality of rooms, the plurality of rooms being independent of the air-conditioning room;

a system controller which controls the air conditioner and the plurality of delivery fans;

a room temperature sensor which obtains a temperature in each of the plurality of rooms and transmits the temperature in each of the plurality of rooms to the system controller; and an air-conditioning room temperature sensor which obtains a temperature in the air-conditioning room and transmits the temperature in the air-conditioning room to the system controller, wherein the system controller includes:

a room target temperature obtainer which obtains a plurality of room target temperatures set for the plurality of rooms in one-to-one correspondence;

an air-conditioning room temperature controller which controls the temperature in the air-conditioning room by causing the air-conditioning room to have a temperature lower than or equal to a lowest one of the plurality of target temperatures when the air conditioner operates in a cooling mode, and causing the air-conditioning room to have a temperature higher than or equal to a highest one of the plurality of target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by the room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the system controller includes:

a total ventilation airflow calculator which calculates a total ventilation airflow that is a sum of ventilation airflows of the plurality of delivery fans; and a ventilation airflow comparator which compares a predetermined ventilation airflow threshold value and the total ventilation airflow calculated by the total ventilation airflow calculator, and when the total ventilation airflow calculated exceeds the predetermined ventilation airflow threshold value in a result of the comparison of the ventilation airflow comparator, the air-conditioning room temperature controller changes the temperature in the air-conditioning room to a lower temperature when the air conditioner operates in the cooling mode, and the air-conditioning room temperature controller changes the temperature in the air-conditioning room to a higher temperature when the air conditioner operates in the heating mode.

7. The air-conditioning system according to claim 6, wherein when the air-conditioning room temperature controller changes the temperature in the air-conditioning room, the ventilation airflows of the plurality of delivery fans are reduced.

8. The air-conditioning system according to claim 1, wherein each of the plurality of delivery fans includes:

a constant airflow control function part which maintains the ventilation airflow at a preset constant level, and the fan airflow controller sets the ventilation airflow of each of the plurality of delivery fans.

9. The air-conditioning system according to claim 1, further comprising:

an exhaust fan which draws air from each of the plurality of rooms and exhausts the air to outside of the plurality of rooms; and an air supply fan which draws air from the outside of the plurality of rooms and supplies the air into the air-conditioning room.

10. An air-conditioning system controller that controls an air conditioner which is installed in an air-conditioning room and conditions air in the air-conditioning room, a plurality of delivery fans which are installed for a plurality of rooms in one-to-one correspondence and deliver the air in the air-conditioning room into the plurality of rooms, the plurality of rooms being independent of the air-conditioning room, the air-conditioning system controller comprising:

a room target temperature obtainer which obtains a plurality of room target temperatures set for the plurality of rooms in one-to-one correspondence;

an air-conditioning room temperature controller which controls a temperature in the air-conditioning room by causing the air-conditioning room to have a temperature lower than or equal to a lowest one of the plurality of room target temperatures when the air conditioner operates in a cooling mode, and causing the air-conditioning room to have a temperature higher than or equal to a highest one of the plurality of room target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by a room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the ventilation airflow determiner includes:

a temperature comparator which calculates a temperature difference by comparing each of the plurality of room target temperatures obtained by the room target temperature obtainer and the temperature in the air-conditioning room obtained by the air-conditioning room temperature sensor, and the ventilation airflow determiner determines the ventilation airflow of each of the plurality of delivery fans on the basis of the temperature difference calculated by the temperature comparator.

11. An air-conditioning system controller that controls an air conditioner which is installed in an air-conditioning room and conditions air in the air-conditioning room, a plurality of delivery fans which are installed for a plurality of rooms in one-to-one correspondence and deliver the air in the air-conditioning room into the plurality of rooms, the plurality of rooms being independent of the air-conditioning room, the air-conditioning system controller comprising:

a room target temperature obtainer which obtains a plurality of room target temperatures set for the plurality of rooms in one-to-one correspondence;

an air-conditioning room temperature controller which controls a temperature in the air-conditioning room by causing the air-conditioning room to have a temperature lower than or equal to a lowest one of the plurality of room target temperatures when the air conditioner operates in a cooling mode, and causing the air-conditioning room to have a temperature higher than or equal to a highest one of the plurality of room target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by a room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the ventilation airflow determiner includes:

a temperature comparator which calculates a temperature difference by comparing each of the plurality of room target temperatures obtained by the room target temperature obtainer and the temperature in a corresponding one of the plurality of rooms obtained by the room temperature sensor; and a temperature difference comparator which compares a temperature difference A calculated by the temperature comparator at predetermined timing A and a temperature difference B calculated by the temperature comparator at timing B at which a predetermined length of time has elapsed since the predetermined timing A, and in response to a result of the comparison of the temperature difference comparator, the ventilation airflow determiner changes the ventilation airflow of each of the plurality of delivery fans to reduce a deviation of the temperature in a corresponding one of the plurality of rooms from a corresponding one of the plurality of room target temperatures.

12. An air-conditioning system controller that controls an air conditioner which is installed in an air-conditioning room and conditions air in the air-conditioning room, a plurality of delivery fans which are installed for a plurality of rooms in one-to-one correspondence and deliver the air in the air-conditioning room into the plurality of rooms, the plurality of rooms being independent of the air-conditioning room, the air-conditioning system controller comprising:

a room target temperature obtainer which obtains a plurality of room target temperatures set for the plurality of rooms in one-to-one correspondence;

an air-conditioning room temperature controller which controls a temperature in the air-conditioning room by causing the air-conditioning room to have a temperature lower than or equal to a lowest one of the plurality of room target temperatures when the air conditioner operates in a cooling mode, and causing the air-conditioning room to have a temperature higher than or equal to a highest one of the plurality of room target temperatures when the air conditioner operates in a heating mode;

a ventilation airflow determiner which determines a ventilation airflow of each of the plurality of delivery fans on the basis of a corresponding one of the plurality of room target temperatures obtained by the room target temperature obtainer, the temperature in a corresponding one of the plurality of rooms obtained by a room temperature sensor, and the temperature in the air-conditioning room controlled by the air-conditioning room temperature controller; and a fan airflow controller which controls the ventilation airflow of each of the plurality of delivery fans according to the ventilation airflow determined by the ventilation airflow determiner, wherein the system controller includes:

a total ventilation airflow calculator which calculates a total ventilation airflow that is a sum of ventilation airflows of the plurality of delivery fans; and a ventilation airflow comparator which compares a predetermined ventilation airflow threshold value and the total ventilation airflow calculated by the total ventilation airflow calculator, and when the total ventilation airflow calculated exceeds the predetermined ventilation airflow threshold value in a result of the comparison of the ventilation airflow comparator, the air-conditioning room temperature controller changes the temperature in the air-conditioning room to a lower temperature when the air conditioner operates in the cooling mode, and the air-conditioning room temperature controller changes the temperature in the air-conditioning room to a higher temperature when the air conditioner operates in the heating mode.

* * * * *